US009429864B1

(12) United States Patent
Miura et al.

(10) Patent No.: US 9,429,864 B1
(45) Date of Patent: Aug. 30, 2016

(54) CHARGING MEMBER, PROCESS CARTRIDGE, AND IMAGE FORMING APPARATUS

(71) Applicant: FUJI XEROX CO., LTD., Tokyo (JP)

(72) Inventors: Hiroyuki Miura, Kanagavva (JP); Takuya Morishige, Kanagawa (JP); Yoshiteru Yamada, Kanagawa (JP); Takuro Hoshio, Kanagawa (JP); Kosuke Narita, Kanagawa (JP); Jiro Korenaga, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/878,017

(22) Filed: Oct. 8, 2015

(30) Foreign Application Priority Data

| | | |
|---|---|---|
| Mar. 26, 2015 | (JP) | 2015-065234 |
| Mar. 26, 2015 | (JP) | 2015-065235 |
| Jun. 24, 2015 | (JP) | 2015-126913 |

(51) Int. Cl.
*G03G 15/02* (2006.01)

(52) U.S. Cl.
CPC ..... *G03G 15/0233* (2013.01)

(58) Field of Classification Search
USPC ..... 399/107, 110, 111, 115, 130, 168, 174, 399/176
See application file for complete search history.

(56) References Cited

U.S. PATENT DOCUMENTS 8,449,975 B2 * 5/2013 Hirakoso ..... G03G 15/0233 399/111

FOREIGN PATENT DOCUMENTS

| | | | |
|---|---|---|---|
| JP | 2001-305836 | A | 11/2001 |
| JP | 2009-175427 | A | 8/2009 |
| JP | 2010-102016 | A | 5/2010 |
| JP | 2010-197936 | A | 9/2010 |

* cited by examiner

*Primary Examiner* — Hoan Tran
(74) *Attorney, Agent, or Firm* — Sughrue Mion, PLLC

(57) ABSTRACT

A charging member includes a conductive support and a surface layer provided on the conductive support, wherein electron emitting energy on a surface of the charging member is equal to or less than 10 $cps^{0.5}/eV$.

15 Claims, 6 Drawing Sheets

CHARGING MEMBER, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2015-65234 filed Mar. 26, 2015, Japanese Patent Application No. 2015-65235 filed Mar. 26, 2015 and Japanese Patent Application No. 2015-126913 filed Jun. 24, 2015.

BACKGROUND

1. Technical Field

The invention relates to a charging member, a process cartridge, and an image forming apparatus.

2. Related Art

In an image forming apparatus using an electrophotographic method, charges are formed by causing a charging device and the like to charge an image holding member (electrophotographic photoreceptor), an electrostatic latent image is formed by using laser beams which is obtained by modulating an image signal, and then the formed latent image is developed by using a charged toner so as to obtain a toner image. The toner image is directly transferred or is transferred through an intermediate transfer member to a recording medium, and thus a required image is obtained.

In this image forming apparatus, a non-contact type charging device such as a corotron and a scorotron has been known as the charging device. The non-contact type charging device performs charging by using corona discharge which occurs by applying a high voltage to a conventional metallic wire. However, recently, a contact type charging device using a charging roll has been widely used instead of the non-contact type charging device, generally for the reason of a low voltage to be applied and a small amount of generated ozone.

SUMMARY

According to an aspect of the invention, there is provided a charging member including:

a conductive support; and a surface layer provided on the conductive support, wherein electron emitting energy on a surface of the charging member is equal to or less than 10 $cps^{0.5}/eV$.

BRIEF DESCRIPTION OF THE DRAWINGS

Exemplary embodiments of the present invention will be described in detail based on the following figures, wherein.

DETAILED DESCRIPTION

Figure 1:
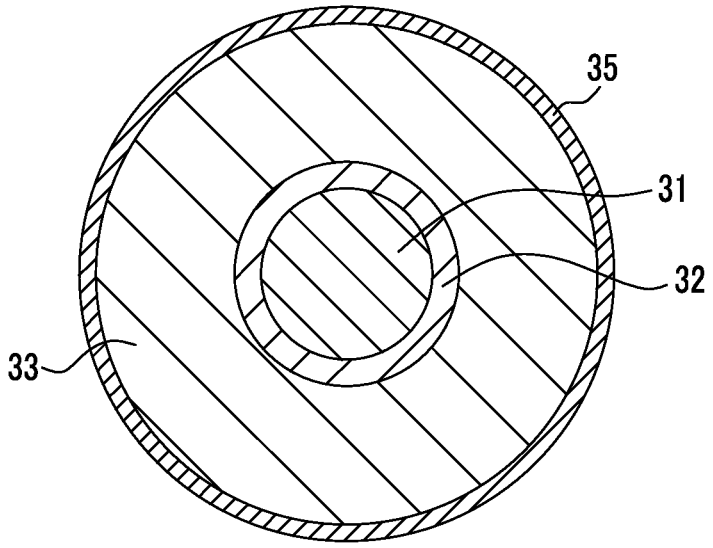
FIG. 1 is a schematic cross-sectional view of a roll in a direction perpendicular to a shaft of the roll, illustrating an example of a charging member according to the exemplary embodiment.

Hereinafter, exemplary embodiments of the present invention will be described in detail.

Charging Member

A charging member according to the exemplary embodiment includes at least of a conductive support and a surface layer provided on the conductive support. Electron emitting energy on a surface of the charging member is equal to or less than 10 $cps^{0.5}/eV$.

As a section configured to charge a charging target member, a contact type charging member that contacts with the surface of the charging target member and performs charging is used. For example, a charging member which includes at least the surface layer on the conductive support and in which, for example, a conductive material for applying conductivity is contained in the surface layer is used.

However, it is not easy to prevent electrical unevenness in these contact type charging members. In addition, charging unevenness, that is, a situation in which an amount of charging for the charging target member varies depending on charged places may occur. For this reason, for example, when this contact type charging member is used as a charging member for charging an image holding member (electrophotographic photoreceptor) in an image forming apparatus, charging unevenness occurs on the image holding member. An image defect due to the charging unevenness may occur in an image formed as a result. Examples of the image defect include a colored spot, a white spot, streaky image defect extended in a shaft direction (direction intersecting with a feeding direction of a recording medium), and the like.

In the contact type charging device using the charging member, a DC charging method using only a DC voltage or an AC superimposition method (AC charging method) using a result obtained by superimposing an AC voltage on a DC voltage is used as a method of applying a voltage. The DC charging method is used appropriately in that the DC charging method has advantages: prevention of wear of a photoreceptor is easier, generation of discharge sound by vibration of the photoreceptor is prevented more than in the AC charging method, an increase of cost of a power source is easily prevented, and the like. However, the DC charging method has a tendency to cause the charging unevenness to occur more than in the AC charging method.

When the image holding member (electrophotographic photoreceptor) used as the charging target member includes the surface layer having charge transportability, the charging unevenness has tendency to occur more as the thickness (total thickness of plural layers when plural layers having the charge transportability are laminated on the surface) of the surface layer having the charge transportability becomes thicker. Particularly, if the thickness is equal to or greater than 25 μm, the charging unevenness occurs more.

As a driving speed (rotation speed) of the charging member becomes slower, that is, as a period of time from when contact occurs at a place at which the charging member and the charging target member are brought into contact with each other, until the charging member and the charging target member are separated from each other becomes longer, the charging unevenness is apt to be caused. Particularly, if the rotation speed of the charging member is equal to or less than 100 mm/s, the charging unevenness occurs more.

A sticking matter may be formed in the surface of the charging member while contact of the charging member with the charging target member and charging of the charging target member are repeated. For example, when the charging member is used in the image forming apparatus, a toner or an external additive may adhere to the surface. If such a sticking matter is formed, prevention of the charging unevenness is more difficult. That is, after charging is repeated, the charging unevenness has a tendency to occur more.

On the contrary, in the exemplary embodiment, the electron emitting energy on the surface of the charging member is equal to or less than 10 $cps^{0.5}/eV$, and thus occurrence of the charging unevenness is prevented.

The reason of showing this effect is not necessarily clear. However, it is considered that conductivity in the surface layer contributes to a charging process performed by the charging member and that discharging from the surface of the surface layer influences the charging process. That is, since it is required that an electron emission characteristic from the surface is controlled so as to perform appropriate discharging, it is presumed that the electron emitting energy on the surface is in the range and thus occurrence of the charging unevenness is prevented.

Occurrence of the charging unevenness after charging is repeated is also prevented in addition to initial charging unevenness. It is considered that this is because the excellent electron emission characteristic is considered to be shown continuously even when staining by the sticking matter occurs on the surface of the charging member and thus discharging is controlled in an appropriate range.

As a result, occurrence of an image defect (a colored spot, a white spot, streaky image defect extended in a shaft direction (direction intersecting with a feeding direction of a recording medium), and the like) in an image due to the charging unevenness is also prevented well by using the charging member according to the exemplary embodiment in the image forming apparatus.

Electron Emitting Energy (Electron Emission Characteristic) on Surface of Charging Member The electron emitting energy (electron emission characteristic) on the surface means an amount of a change of the number of emitted photoelectrons when an amount of energy with which the surface is irradiated is gradually increased. Thus, particularly, the electron emitting energy on the surface uses an amount of a change ($cps^{0.5}/eV$) when emission of electrons is started. The electron emitting energy on the surface is measured as follows: a measurement sample of the surface layer is irradiated with spectral ultraviolet rays obtained through a monochromator in the air atmosphere while energy is changed. Then, energy with which emission of a photoelectron is started by the photoelectric effect is obtained.

Specifically, a measurement sample of the surface layer (including an elastic layer when the surface layer has the elastic layer) is picked from the charging member by using a cutter and the like. Then, the electron emitting energy ($cps^{0.5}/eV$) is measured by using an atmospheric photoelectron spectroscopy AC-2 (product manufactured by RIKEN KEIKI Co., Ltd.).

Figure 7:
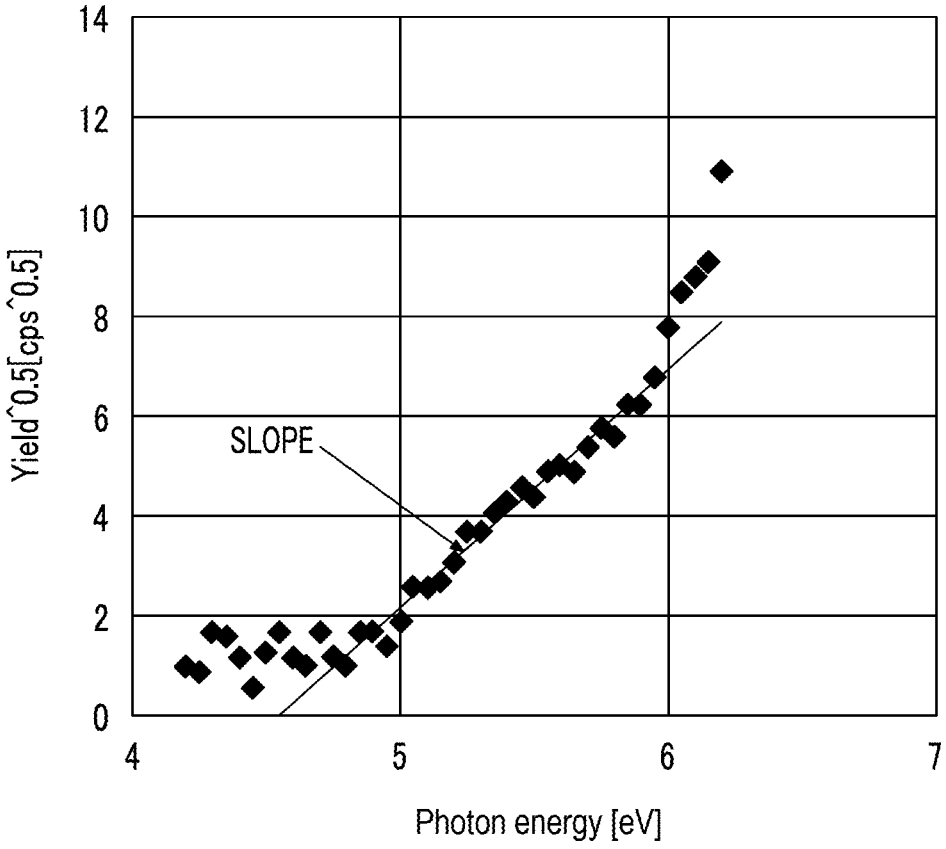
FIG. 7 is a graph illustrating a result of measuring an amount of a change of the number of emitted photoelectrons when an amount of energy with which a surface of a measurement sample is irradiated is gradually increased.

FIG. 7 illustrates a result of measuring the amount of a change of the number of emitted photoelectrons when the amount of energy with which the surface of the measurement sample is irradiated is gradually increased, by using the atmospheric photoelectron spectroscopy AC-2. An amount of an increase (slope of an electron emission line in FIG. 7) obtained by increase in emitted photoelectrons is set as the electron emitting energy.

In the charging member according to the exemplary embodiment, the electron emitting energy on the surface is equal to or less than 10 $cps^{0.5}/eV$, and is preferably in a range of from 2 $cps^{0.5}/eV$ to 10 cps $cps^{0.5}/eV$. The electron emitting energy on the surface is more preferably in a range of from 2 $cps^{0.5}/eV$ to 8 $cps^{0.5}/eV$, and is further preferably in a range of from 4 $cps^{0.5}/eV$ to 6 $cps^{0.5}/eV$. It is considered that discharging from the surface of the charging member is controlled in a required range when the electron emitting energy is in the ranges. Thus, occurrence of the charging unevenness is prevented better. The electron emitting energy on the surface of the charging member is determined in accordance with composition, a surface property, and the like in addition to the type of a material to be used.

Incorporation of Conductive Material Containing Phosphor-Doped Tin Oxide

In the exemplary embodiment, a conductive material containing phosphor-doped tin oxide (also simply referred to as a "phosphor-doped tin oxide-containing conductive material" below) is preferably contained in the surface layer. The electron emitting energy on the surface of the charging member may be easily controlled in the range by incorporating the phosphor-doped tin oxide-containing conductive material. It is considered that the incorporation of the phosphor-doped tin oxide-containing conductive material causes the conductivity of the surface layer to be controlled in a required range and causes the electron emission characteristic from the surface to be controlled in a required range, and thus discharging may be appropriately performed. It is presumed that contribution of these further prevents the occurrence of the charging unevenness.

Examples of the phosphor-doped tin oxide-containing conductive material include phosphor-doped tin oxide particles and conductive metal oxide particles coated with phosphor-doped tin oxide. Details of the examples of phosphor-doped tin oxide-containing conductive material will be described later.

Content of Phosphor-Doped Tin Oxide-Containing Conductive Material

A content (ratio to 100 parts by weight of resin (polymeric material) in the surface layer) of the phosphor-doped tin oxide-containing conductive material in the surface layer is not particularly limited. However, the content of the phosphor-doped tin oxide-containing conductive material is preferably in a range of from 5 parts by weight to 180 parts by weight, is more preferably in a range of from 10 parts by weight to 170 parts by weight, and is further preferably in a range of from 20 parts by weight to 160 parts by weight.

When, as the conductive material, other conductive materials (conductive material which does not include phosphor-doped tin oxide) are not used with the phosphor-doped tin oxide-containing conductive material, and only the phosphor-doped tin oxide-containing conductive material is used, the content (ratio to 100 parts by weight of resin (polymeric material) in the surface layer) of the phosphor-doped tin oxide-containing conductive material in the surface layer is not particularly limited. However, the content of the phosphor-doped tin oxide-containing conductive material is preferably in a range of from 80 parts by weight to 180 parts by weight, is more preferably in a range of from 110 parts by weight to 170 parts by weight, and is further preferably in a range of from 120 parts by weight to 160 parts by weight.

Initial occurrence of the charging unevenness and the occurrence of the charging unevenness after the charging is repeated are prevented well when the content of the phosphor-doped tin oxide-containing conductive material is in the range. It is considered that this is because the conductivity of the surface layer is controlled in the required range when the content of the phosphor-doped tin oxide-containing conductive material is equal to or greater than the lower limit value, and because a degree of discharging from the surface layer is controlled in the required range when the content of the phosphor-doped tin oxide-containing conductive material is equal to or less than the upper limit value.

Carbon Black

It is preferable that carbon black is further contained as the conductive material in the surface layer. The carbon black is used together, and thus an effect of prevention of the charging unevenness is well shown even though a content of all of the conductive materials is reduced. That is, an effect of prevention of the charging unevenness is obtained while reducing an amount of the conductive material.

Content of Phosphor-Doped Tin Oxide-Containing Conductive Material and Carbon Black When the phosphor-doped tin oxide-containing conductive material and the carbon black are used together, the content (ratio to 100 parts by weight of resin (polymeric material) in the surface layer) of the phosphor-doped tin oxide-containing conductive material in the surface layer is not particularly limited. However, the content is preferably in a range of from 5 parts by weight to 180 parts by weight, is more preferably in a range of from 10 parts by weight to 100 parts by weight, and is further preferably in a range of from 20 parts by weight to 60 parts by weight. The initial occurrence of the charging unevenness and the occurrence of the charging unevenness after the charging is repeated are prevented well when the content of the phosphor-doped tin oxide-containing conductive material is in the range.

A content ratio of the phosphor-doped tin oxide-containing conductive material and the carbon black (phosphor-doped tin oxide-containing conductive material: carbon black (weight ratio)) is not particularly limited. However, the following ranges are preferable.

A range of 10:25(=0.4:1) to 100:5(=20:1) is preferable.

A range of 20:15 (≅1.33:1) to 80:10 (=8:1) is more preferable.

A range of 20:15(≅1.33:1) to 60:10(=6:1) is still more preferable.

The initial occurrence of the charging unevenness and the occurrence of the charging unevenness after the charging is repeated are prevented better when the content ratio is in the range.

A configuration of the charging member according to the exemplary embodiment will be described in detail below.

Examples of the shape of the charging member include a roll shape, a sheet shape, a blade shape, and the like, and the shape is not particularly limited. However, among these shapes, a charging roll having the roll shape in which at least the surface layer is provided on an outer circumference surface of a cylindrical or columnar conductive support is preferable.

Hereinafter, the charging roll which is one form of the charging member will be used as an example and a configuration of the charging roll will be described.

FIG. 1 illustrates an example of the charging member (charging roll) according to the exemplary embodiment, and FIG. 1 is a schematic cross-sectional view of the charging roll in a direction perpendicular to a shaft of the roll. The charging roll illustrated in FIG. 1 includes an adhesive layer 32, an elastic layer 33, and a surface layer 35 on a conductive support 31.

Figure 2:
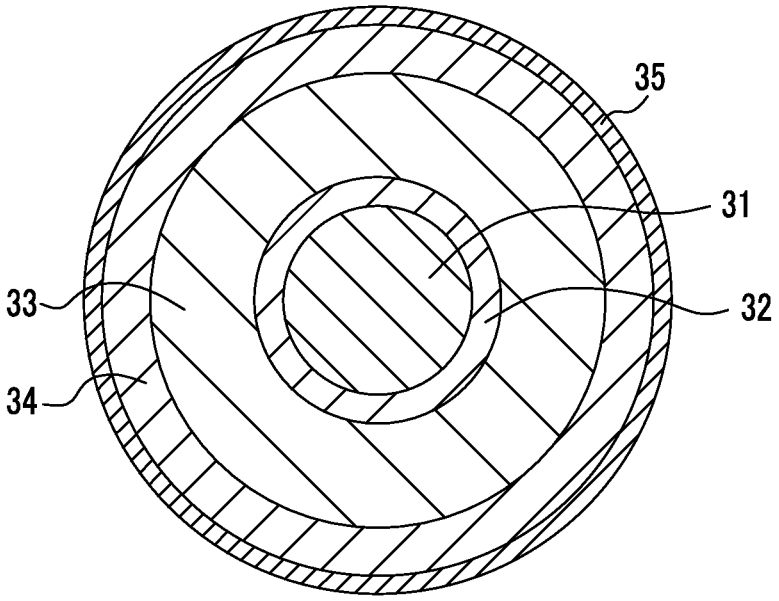
FIG. 2 is a schematic cross-sectional view of the roll in the direction perpendicular to the shaft of the roll, illustrating another example of the charging member according to the exemplary embodiment.

FIG. 2 illustrates another example of the charging member (charging roll) according to the exemplary embodiment, and FIG. 2 is a schematic cross-sectional view of the charging roll in the direction perpendicular to a shaft of the roll. The charging roll illustrated in FIG. 2 includes the adhesive layer 32, the elastic layer 33, an intermediate layer 34, and the surface layer 35 on the conductive support 31.

The configuration of the charging roll according to the exemplary embodiment is not limited thereto. The charging roll may have other configurations as long as the charging roll includes the conductive support and the surface layer having the above-described configuration. For example, the charging roll may not include the adhesive layer 32 illustrated in FIGS. 1 and 2.

Descriptions will be made below mainly focused on the configuration of the charging roll illustrated in FIG. 1. In the following descriptions, reference signs may be omitted.

In this specification, the conductivity means that volume resistivity at 20° C. is less than $1\times10^{13}$ Ωcm.

Conductive Support

The conductive support 31 will be described.

The conductive support 31 functions as an electrode and a support of the charging roll. Thus, a member formed of metal or alloys such as aluminum, copper alloys, stainless steel, and the like; iron subjected to plating treatment using chrome, nickel, and the like, a substance formed of a material obtained by performing plating treatment on free-cutting steel described in, for example, JIS G4804, with chrome, nickel, and the like is used as the conductive support 31. Metal plating may be performed by using an electrolysis plating method, an electroless plating method, or the like, and it is not limited thereto.

Adhesive Layer

A material for forming the adhesive layer 32 is not particularly limited. However, for example, materials such as polyolefin, chlorine rubber, acryl, epoxy, polyurethane, nitrile rubber, vinyl chloride, vinyl acetate, polyester, phenol, and silicone materials are used. From a viewpoint of adhesion to rubber or elastomer for forming the elastic layer, a polyolefin or phenol material is particularly preferable.

The adhesive layer may have a configuration in which plural layers are combined in addition to a single-layer configuration.

A polymeric material such as liquid rubber, powder, and the like may be added to the adhesive layer. Examples of the powder include carbon black such as ketchen black with conductivity, and acetylene black; pyrolytic carbon, graphite; various types of conductive metal such as aluminum, copper, nickel, stainless steel, alloys thereof, and the like; various conductive metal oxide such as tin oxide, indium oxide, titanium oxide, tin oxide-antimony oxide solid solutions, and tin oxide-indium oxide solid solutions; and a substance obtained by performing conduction treatment on the surface of an insulating material.

The thickness of the adhesive layer is not particularly limited. However, the thickness of the adhesive layer is for example, preferably, in a range of from 1 μm to 100 μm, and more preferably in a range of from 5 μm to 50 μm.

Elastic Layer

The elastic layer 33 is a member having a function to apply elasticity to the charging member according to the exemplary embodiment. Including the elastic layer causes a nip with the charging target member to be formed well. The charging member including the elastic layer has a tendency to cause the above-described charging unevenness to occur more due to formation of the nip with the charging target member. However, according to the exemplary embodiment, even when the elastic layer is included, the occurrence of the above-described charging unevenness is prevented well.

Rubber Component

The elastic layer may be formed by a rubber component of various types of rubber or elastomer and the like.

From a viewpoint of prevention of resistance unevenness, epichlorohydrin rubber is preferable as the rubber component. Particularly, epichlorohydrin-ethylene oxide copolymer rubber, epichlorohydrin-ethylene oxide-allyl glycidyl ether copolymer rubber, and the like are preferable.

The elastic layer preferably has the epichlorohydrin rubber as a main component. "to have the epichlorohydrin rubber as a main component" means that the content of the epichlorohydrin rubber is the greatest among rubber components included in the rubber composition for forming the elastic layer. A content of the epichlorohydrin rubber among the rubber components is preferably equal to or greater than 50% by weight, and is more preferably equal to or greater than 90% by weight. Particularly preferably, all (100% by weight) of the rubber component is the epichlorohydrin rubber.

Examples of other rubber component used with the epichlorohydrin rubber or other rubber components replaceable with the epichlorohydrin rubber include isoprene rubber, chloroprene rubber, butyl rubber, polyurethanes, silicone rubber, fluorine rubber, styrene-butadiene rubber, butadiene rubber, nitrile rubber, ethylene-propylene rubber, ethylene-propylene-diene terpolymer rubber (EPDM), acrylonitrile-butadiene copolymer rubber (NBR), natural rubber, and the like.

The rubber component may be independently used or combination of two or more types thereof may be used.

Conductive Material

From a viewpoint of imparting the conductivity, a conductive material may be added to the elastic layer. As the conductive material, an electron conductive material or an ion conductive material is used.

Examples of the electron conductive material include powder of carbon black such as ketchen black and acetylene black; pyrolytic carbon, graphite; various types of conductive metal such as aluminum, copper, nickel, stainless steel, alloys thereof, and the like; various types of conductive metal oxide such as tin oxide, indium oxide, titanium oxide, tin oxide-antimony oxide solid solution, and tin oxide-indium oxide solid solutions; and a substance obtained by performing conduction treatment on the surface of an insulating material.

Examples of the ion conductive material include perchlorate, chlorate, and the like, of tetraethyl ammonium, lauryl trimethyl ammonium, and the like; and perchlorate, chlorate, and the like of alkaline-earth metal and alkali metal such as lithium and magnesium.

These conductive materials may be independently used or combination of two or more types thereof may be used.

An addition amount of the conductive material is not particularly limited. However, in a case of the electron conductive material, the electron conductive material is preferably in a range of from 1 part by weight to 30 parts by weight relative to 100 parts by weight of the rubber component, and is more preferably in a range of from 5 parts by weight to 25 parts by weight.

In a case of the ion conductive material, the ion conductive material is preferably in a range of from 0.1 parts by weight to 5.0 parts by weight relative to 100 parts by weight of the rubber component, and is more preferably in a range of from 0.5 parts by weight to 3.0 parts by weight.

Crosslinking Agent

When the rubber component is cross-linked, a material such as a crosslinking agent and a crosslinking accelerator is further used. Generally, as the type of crosslinking by the crosslinking agent, sulfur crosslinking, peroxide crosslinking, quinoid crosslinking, phenol resin crosslinking, amine crosslinking, metal oxide crosslinking, and the like are included. However, from a viewpoint of easy crosslinking to a material having a double bond and flexibility of crosslinked rubber, crosslinking with sulfur is preferable. With respect to sulfur crosslinking, not the crosslinking performed by using elemental sulfur, but the crosslinking using the crosslinking agent which cause activated sulfur to be released from a compound is preferable because a distance between bonds may be reduced. 4,4' dithiodimorpholine is suitable.

Examples of the crosslinking accelerator include those containing thiazole, thiuram, sulfenamide, thiourea, dithiocarbamate, guanidine, aldehyde-ammonia, a mixture of these substances, or the like.

Other Additives

As the rubber composition for forming the elastic layer according to the exemplary embodiment, a substance obtained by mixing other additives may be used as necessary. As the other additives, a filler, an activator, and the like are included.

In addition, examples of the filler to be mixed include a mixture of silica, calcium carbonate, clay, and the like.

As the activator to be mixed, zinc oxide and the like are included.

An addition amount of the other additives including particles of carbon black, zinc oxide as the vulcanization acceleration assistant, and the like, is preferably in a range of from 10 parts by weight to 100 parts by weight relative to 100 parts by weight of the rubber component, and is more preferably in a range of from 20 parts by weight to 80 parts by weight relative to 100 parts by weight of the rubber component.

When a resistive layer is formed, the component material (rubber composition) of the elastic layer may be used as a component material of the resistive layer.

The thickness of the elastic layer is preferably in a range of from 1 mm to 10 mm, and is more preferably in a range of from 2 mm to 5 mm.

The volume resistivity of the elastic layer is preferably in a range of from $10^3$ Ωcm to $10^{14}$ Ωcm.

Formation of Elastic Layer

For example, the elastic layer is formed as follows: a composition for forming the elastic layer is prepared by kneading a mixture of the above-described components. The composition is extruded onto the conductive support by means of an extrusion machine provided with a crosshead, an injection molding machine, a press-molding machine, or the like and is vulcanized.

Surface Layer

The surface layer may preferably include at least of the conductive material and a resin. The surface layer may include a filler for adjusting surface roughness of the surface layer, other additives, and the like.

Conductive Material

In the exemplary embodiment, it is preferable that the conductive material including the phosphor-doped tin oxide is contained in the surface layer.

As a shape of the phosphor-doped tin oxide-containing conductive material, for example, a particle shape is included. A shape of particles of the phosphor-doped tin oxide-containing conductive material is not particularly limited. However, for example, a spherical shape is preferable.

A primary particles size (number average particles size) of the phosphor-doped tin oxide-containing conductive material is not particularly limited. However, the primary particles size is preferably in a range of 20 nm or less, and is more preferably in a range of from 8 nm to 12 nm.

The primary particles size (number average particles size) of the phosphor-doped tin oxide-containing conductive material is measured by using a scanning electron microscope (SEM). An average particles size is an average value of measured particles sizes of plural particles.

Examples of the phosphor-doped tin oxide-containing conductive material include phosphor-doped tin oxide particles and conductive metal oxide particles coated with phosphor-doped tin oxide.

Phosphor-Doped Tin Oxide Particles

Powder resistivity (volume resistivity) of the phosphor-doped tin oxide particles is not particularly limited. However, the powder resistivity is preferably in a range of from 1 Ω·cm to 100 Ω·cm, is more preferably in a range of from 5 Ω·cm to 50 Ω·cm, and is further preferably in a range of from 10 Ω·cm to 40 Ω·cm.

The powder resistivity is measured as follows: particles of phosphor-doped tin oxide are fixed so as to prepare a measurement sample, and resistance is measured by a resistance measurement device capable of applying of a microcurrent. Measurement is performed plural times to employ an average value of results of measurement.

As a commercial product of the phosphor-doped tin oxide particles, specifically, SP-2 which is a product manufactured by Mitsubishi Materials Electronic Chemicals Co., Ltd, and the like are included.

Conductive Metal Oxide Particles Coated with Phosphor-Doped Tin Oxide

The conductive metal oxide particles coated with phosphor-doped tin oxide (also simply referred to as "P-doped tin oxide coating conductive material particles" below) are particles of conductive metal oxide of which the surface is coated with phosphor-doped tin oxide.

Examples of conductive metal oxide include titanium oxide, indium oxide, tin oxide, tin oxide-antimony oxide solid solutions, and tin oxide-indium oxide solid solutions. Among these substances, titanium oxide is more preferable.

An amount of coating with phosphor-doped tin oxide (weight ratio of phosphor-doped tin oxide for the total amount (weight) of conductive metal oxide coated with phosphor-doped tin oxide) is not particularly limited. The amount of coating may be adjusted in accordance with required performance.

As a commercial product of the P-doped tin oxide-coated conductive material particles, specifically, W-4 (titanium oxide coated with phosphor-doped tin oxide) which is a product manufactured by Mitsubishi Materials Electronic Chemicals Co., Ltd, and the like are included.

Other Conductive Materials

With respect to the surface layer, other conductive materials may be used in combination with the phosphor-doped tin oxide-containing conductive material.

As the other conductive material which may be used together in the surface layer, an electron conductive material and an ion conductive material are included. As an example of the electron conductive material, powders of the following substances are included: carbon black such as ketchen black and acetylene black; pyrolytic carbon, graphite; various types of conductive metal such as aluminum, copper, nickel, stainless steel, alloys thereof, and the like; various types of conductive metal oxide such as tin oxide, indium oxide, titanium oxide, tin oxide-antimony oxide solid solutions, and tin oxide-indium oxide solid solutions; a substance obtained by performing conduction treatment on the surface of an insulating material; and the like. Examples of the ion conductive material include perchlorate, chlorate and the like of tetraethyl ammonium and lauryl trimethyl ammonium; perchlorate, chlorate and the like of an alkaline-earth metal or an alkali metal such as lithium and magnesium, and the like. These other conductive materials may be independently used or combination of two or more types thereof may be used.

As the other conductive material used with the phosphor-doped tin oxide-containing conductive material, carbon black is preferable among the above-described substances. An effect of prevention of the charging unevenness is well shown by using the phosphor-doped tin oxide-containing conductive material and carbon black together, even though a content of all of the conductive materials is reduced. That is, both of an effect of prevention of the charging unevenness and reduction of an amount of the conductive material are obtained.

Carbon black is not particularly limited, but an acid type of carbon black is more preferable.

Specifically, examples of a commercial product of carbon black include "MONARCH 1000", "MONARCH 1300", "MONARCH 1400", "MOGUL-L", and "REGAL 400R" which are products manufactured by Cabot Corporation, "Special Black 350", "Special Black 100", "Special Black 250", "Special Black 5", "Special Black 4", "Special Black 4A", "Special Black 550", "Special Black 6", "Color Black FW200", "Color Black FW2", and "Color Black FW2V" which are products manufactured by Orion Engineered Carbons Ltd., and the like.

The content of the phosphor-doped tin oxide-containing conductive material in the surface layer is preferably in the above-described range. The above-described ranges may be applied to the following contents and content ratio, respectively: a preferable content when other conductive materials (conductive material which does not contain phosphor-doped tin oxide) are not used together as the conductive material, and only the phosphor-doped tin oxide-containing conductive material is used; a preferable content when the phosphor-doped tin oxide-containing conductive material and the carbon black are used together; a preferable content ratio of the phosphor-doped tin oxide-containing conductive material and the carbon black in this case; and the like.

Filler

In view of controlling electrical characteristics or forming convex portions for the surface roughness in the surface layer, filler may be added to the surface layer. Adding of the filler causes the surface roughness of the surface layer to be controlled in an appropriate range, causes prevention of occurrence of staining due to attachment of a sticking matter (for example, a toner, an external additive, or the like) to the surface of the charging member, and causes the occurrence of the charging unevenness after charging is repeated to be prevented more.

As the filler, any of conductive particles and nonconductive particles may be used, but the nonconductive particles are desired.

As the conductive particles, particles of a material exemplified as the conductive material which is added to the surface layer are exemplified. Examples of the nonconductive particles include resin particles, inorganic particles, ceramic particles, or the like. The resin particles include polyamide resin particles, polyimide resin particles, methacrylic resin particles, polystyrene resin particles, fluororesin particles, silicone resin particles, and the like. The inorganic particles include clay particles, kaolin particles, talc particles, silica particles, alumina particles, and the like. One type of the filler may be independently used or two or more types of the filler may be used together.

The filler may be particles configured by a resin of the same type as a resin (polymeric material) which will be described later. The conductivity means that the volume resistivity is less than $10^{13}$ Ωcm, and the nonconductivity means that the volume resistivity is equal to or greater than $10^{13}$ Ωcm.

A content of the filler is not particularly limited. However, the content of the filler is preferably in a range of from 1 part by weight to 100 parts by weight relative to 100 parts by weight of the resin (polymeric material) which will be described later, and is more preferably in a range of from 5 parts by weight to 60 parts by weight.

From a viewpoint of prevention of charging unevenness, the surface roughness Rz of the surface layer formed by using the filler is preferably in a range of from 2 μm to 15 μm, and is more preferably in a range of from 3 μm to 10 μm.

In the exemplary embodiment, the surface roughness Rz is a ten-point average roughness Rz in JIS B0601 (1994). A measurement target is measured under a condition of 0.8 mm of a cutoff, 4.0 mm of a measuring length, and 0.3 mm/sec of a traverse speed, at three places (for example, if the measurement target is roll-shaped, three places of the center portion, and portions which are 20 mm separated from both ends, in the shaft direction) by using a surface roughness measuring instrument (Surfcom 1400 which is a product manufactured by TOKYO SEIMITSU CO., LTD.). Then, an average value of results of measurement is calculated, and thus the surface roughness Rz is obtained.

Resin

The surface layer may contain a resin (polymeric material). Examples of the resin (polymeric material) for forming the surface layer are not particularly limited, but include polyamide, polyurethane, polyvinylidene fluoride, tetrafluoroethylene copolymer, polyester, polyimide, silicone resin, acrylic resin, polyvinyl butyral, ethylene tetrafluoroethylene copolymer, melamine resin, fluorine rubber, epoxy resin, polycarbonate, polyvinyl alcohol, cellulose, poly vinylidene chloride, polyvinyl chloride, polyethylene, ethylene-vinyl acetate copolymer, copolyamide, and the like.

The resin may be independently used, or a mixture or copolymer of two or more types thereof may be used. In a case of crosslinkable resin, crosslinking may be performed and thereby the obtained substance may be used. The number average molecular weight of the resin (polymeric material) is preferably in a range of from 1,000 to 100,000, and is more preferably in a range of from 10,000 to 50,000.

As the other additive in the surface layer, a general material allowed to be added to the surface layer is included, and examples of the general material include a hardener, a vulcanizing agent, a vulcanization accelerator, an antioxidant, a dispersant, a surfactant, a coupling agent, and the like.

The thickness of the surface layer is preferably in a range of from 1 μm to 20 μm, and is more preferably in a range of from 3 μm to 15 μm. The volume resistivity of the surface layer is preferably in a range of from $10^3$ Ωcm to $10^{14}$ Ωcm.

Formation of Surface Layer

The surface layer may be formed by performing the following procedures. A coating liquid is prepared by dispersing the resin, the conductive material, and the like in a solvent. Then, this coating liquid is applied onto a pre-prepared elastic layer and is dried. Examples of an application method of the coating liquid include a blade coating method, a wire bar coating method, a spray coating method, a dipping coating method, a bead coating method, an air knife coating method, a curtain coating method, and the like.

The solvent used in the coating liquid is not particularly limited, and a general solvent is used as the solvent. For example, solvents of the following types may be used as the solvent used in the coating liquid: alcohols such as methanol, ethanol, propanol, and butanol; ketones such as acetone and methyl ethyl ketone; tetrahydrofuran; ethers such as diethyl ether and dioxane.

Charging Device

The charging device according to the exemplary embodiment includes the charging member according to the exemplary embodiment.

For example, the charging device according to the exemplary embodiment may be configured by only the charging member according to the exemplary embodiment, or may have a configuration in which the charging member according to the exemplary embodiment and a cleaning member are provided so as to contact with each other with a specific amount of engagement.

As a method of applying a voltage to the charging member, a DC charging method of applying only a DC voltage and an AC superimposition method of superimposing an AC voltage on a DC voltage and applying a result of superimposition are included. In the exemplary embodiment, from a viewpoint of wear of the photoreceptor, occurrence of ozone, discharge sound occurring by vibration of photoreceptor, the DC charging method of applying a DC voltage is preferable. The DC charging method has a tendency to cause the above-described charging unevenness to occur more than in the AC charging method. However, according to the exemplary embodiment, even when the DC charging method is employed, the occurrence of the charging unevenness is also prevented well.

Use

The charging device including the charging member according to the exemplary embodiment is used for charging the charging target member in a state where the charging device contacts with the charging target member. For example, the charging device is appropriately used as a charging member in an image forming apparatus. Specifically, the charging device is used as a charging member for charging an image holding member (electrophotographic photoreceptor), or is used as a transfer member for transferring a toner to a recording medium from an image holding member (electrophotographic photoreceptor).

Image Forming Apparatus

The image forming apparatus according to the exemplary embodiment includes an image holding member, a charging device, a latent image forming device, a developing device, and a transfer device. The charging device includes the charging member according to the exemplary embodiment which contacts with a surface of the image holding member and charges the surface of the image holding member. The latent image forming device forms a latent image on the charged surface of the image holding member. The developing device develops the latent image formed on the surface of the image holding member by using a toner, and thus forms a toner image. The transfer device transfers the toner image formed on the surface of the image holding member to a recording medium.

The image forming apparatus according to the exemplary embodiment will be described with reference to the accompanying drawings.

First Exemplary Embodiment

Figure 3:
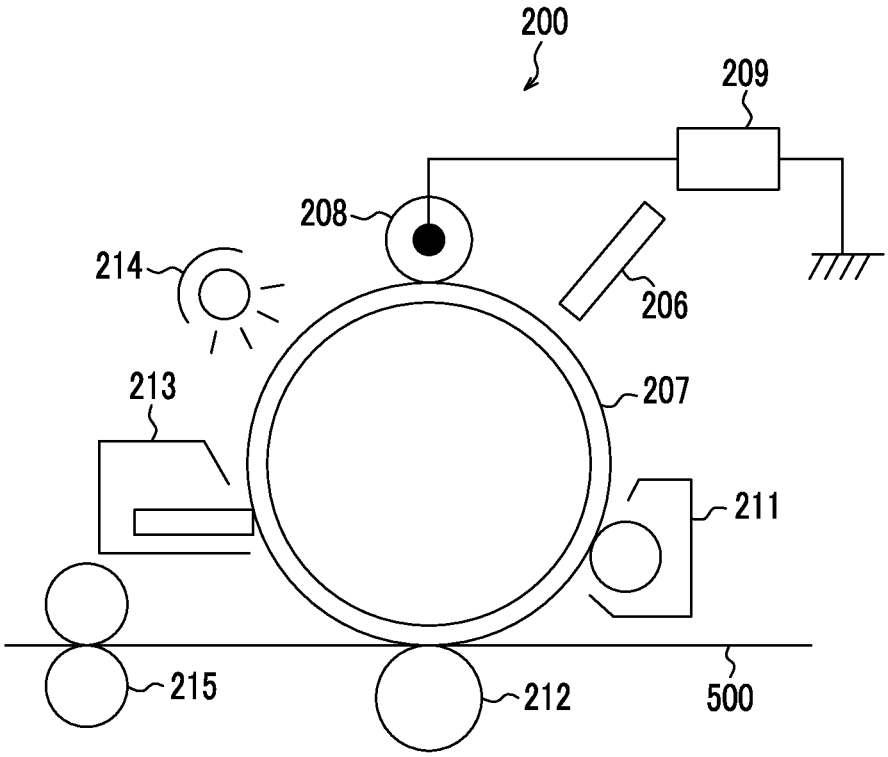
FIG. 3 is a schematic diagram illustrating a basic configuration of an image forming apparatus according to a first exemplary embodiment.

FIG. 3 is a schematic diagram illustrating a basic configuration of an image forming apparatus according to a first exemplary embodiment. An image forming apparatus 200 illustrated in FIG. 3 includes an electrophotographic photoreceptor (an example of the image holding member) 207, a charging device 208 for charging the electrophotographic photoreceptor 207, a power supply 209 connected to the charging device 208, an exposure device (an example of the latent image forming device) 206, a developing device 211, a transfer device 212, a cleaning device 213, an erasing device 214, and a fixation device 215. The exposure device 206 causes the electrophotographic photoreceptor 207 charged by the charging device 208 to be exposed and thus forms a latent image. The developing device 211 develops the latent image which is formed by the exposure device 206 by using a toner, and thus forms a toner image. The transfer device 212 transfers the toner image formed by the developing device 211 to a recording medium 500. The erasing device 214 illustrated in FIG. 3 may not be provided.

The electrophotographic photoreceptor 207 is not particularly limited, and a known electrophotographic photoreceptor may be used as the electrophotographic photoreceptor 207. Exemplified is a photoreceptor including a function-separated photosensitive layer, in which an undercoating layer, a charge generation layer, and a charge transport layer are laminated on a conductive substrate in this order, and thus the charge generation layer and the charge transport layer are provided separately from each other. In addition, a photoreceptor including a function-integrated photosensitive layer may be used. The function-integrated photosensitive layer has both of a charge generation function and a charge transport function. In the electrophotographic photoreceptor 207, the undercoating layer may not be included, and an intermediate layer may be provided between the undercoating layer and the photosensitive layer. A protective layer containing a charge transport material may be provided on the photosensitive layer.

From a viewpoint of long lifetime and prevention of occurrence of an image defect, in the electrophotographic photoreceptor 207 according to the exemplary embodiment, the total thickness of the surface layer having charge transportability is preferably equal to or greater than 25 μm, and more preferably in a range of from 25 μm to 32 μm.

As the thickness of the surface layer having charge transportability becomes thicker, the electrophotographic photoreceptor 207 has a tendency to cause the above-described charging unevenness to occur more. Particularly, if the thickness is equal to or greater than 25 μm, the charging unevenness occurs much more. However, in the exemplary embodiment, even when the thickness of the surface layer having the charge transportability is equal to or greater than 25 μm, the occurrence of the charging unevenness is prevented much more by including the charging member according to the exemplary embodiment.

In the exemplary embodiment, the "surface layer having the charge transportability" in the photoreceptor corresponds to the charge transport layer when the charge transport layer containing a charge transport material is the top layer in a function-separated photosensitive layer, and when a protective layer containing a charge transport material is provided on the charge transport layer, it has a thickness which is the total thickness of the charge transport layer and the protective layer. In addition, the "surface layer having the charge transportability" corresponds to the photosensitive layer when a function-integrated photosensitive layer containing a charge transport material is the top layer, and when a protective layer containing a charge transport material is provided on the function-integrated photosensitive layer, it has a thickness which is the total thickness of the photosensitive layer and the protective layer.

The charging device 208 is a device using a method (contact charging method) in which a charging member (charging roll) contacts with the surface of the electrophotographic photoreceptor 207, and the surface of the photoreceptor 207 is charged. A charging device including the charging member according to the above-described exemplary embodiment is used as the charging device 208.

In the image forming apparatus 200, a rotation speed (process speed) of the electrophotographic photoreceptor 207 is set in accordance with the type of an image to be formed or the type of the recording medium 500 to be used. A driving speed (rotation speed) of the charging member (charging roll) in the charging device 208 is also adjusted so as to match with the rotation speed of the electrophotographic photoreceptor 207. For example, as a recording medium having a large thickness, such as thick paper, is used as the recording medium 500, the rotation speed of the electrophotographic photoreceptor 207 may become slow and the driving speed (rotation speed) of the charging roll may be also set to be slow.

As the driving speed (rotation speed) of the charging roll becomes slower, that is, as a period of time from when certain places of the charging roll and the electrophotographic photoreceptor 207 come into contact with each other until the certain places of the charging roll and the electrophotographic photoreceptor 207 are separated from each other, becomes longer, there is a tendency to cause the charging unevenness to occur more. Particularly, if the rotation speed of the charging roll is equal to or less than 100 mm/s, the charging unevenness occurs much more. On the contrary, in the exemplary embodiment, even when the rotation speed of the charging roll is equal to or less than 100 mm/s, the occurrence of the charging unevenness is prevented much more by including the charging roll according to the exemplary embodiment.

As the exposure device 206, an optical system device, and the like may be used. In the optical system device, exposure may be performed so as to form a desired image shape by irradiating the surface of the electrophotographic photoreceptor with a light source such as a semiconductor laser, a light emitting diode (LED), and a liquid crystal shutter.

A toner is accommodated in the developing device 211. The toner used in the exemplary embodiment contains a binder resin and a colorant, for example. Examples of the binder resin may include homopolymer and copolymer of styrenes, monoolefins, vinyl esters, α-methylene aliphatic monocarboxylic acid esters, vinyl ethers, vinyl ketones, and the like. Particularly, examples of the representative binder resin include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, and polypropylene. In addition, polyester, polyurethane, epoxy resin, silicone resin, polyamide, modified rosin, paraffin wax, and the like are also included.

Examples of the colorant representatively include magnetic powder such as magnetite, ferrite, and the like, carbon black, aniline blue, calcoil blue, chrome yellow, ultramarine blue, Du Pont oil red, Quinoline Yellow, methylene blue chloride, phthalocyanine blue, malachite green oxalate, lamp black, Rose bengal, CI Pigment Red 48:1, CI Pigment Red 122, CI Pigment Red 57:1, CI Pigment Yellow 97, CI Pigment Yellow 17, CI Pigment Blue 15:1, CI Pigment Blue 15:3, and the like.

Internal addition treatment or external addition treatment may be performed and thus known additives such as a charge-controlling agent, a release agent, and other inorganic particles may be added to the toner.

Representative examples of the release agent include low molecular polyethylene, low molecular polypropylene, Fischer-Tropsch wax, montan wax, carnauba wax, rice wax, candelilla wax, and the like.

As the charge-controlling agent, a known charge-controlling agent may be used, and examples thereof include an azo metal complex compound, a metal complex compound of salicylic acid, a resin type charge-controlling agent which contains a polar group, and the like.

As the other inorganic particles, inorganic particles having a small diameter, that is, having an average primary particle diameter of 40 nm or less may be used for purposes of powder fluidity, charging control, and the like. In addition, inorganic or organic particles having a large primary diameter may be used together as necessary in order to reduce adhesion force. As these other inorganic particles, known inorganic particles may be used.

The inorganic particles having a small diameter are effective because performing of surface treatment causes improvement of dispersibility and thus an effect of increasing powder fluidity becomes large.

As a method of preparing the toner, which is used in the exemplary embodiment, a polymerization method such as an emulsion polymerization aggregation method and a dissolution suspension method is preferably used in order to obtain high shape controllability. In addition, a preparing method in which a toner obtained by using the above-described method is used as a core, aggregation particles are caused to adhere to the core, and to coalesce with the core by performing heating, and thus a core shell structure is obtained may be performed. When an external additive is added, preparing may be performed by mixing the toner and the external additive in a Henschel mixer or a V blender. When the toner is prepared by using a wet type method, external adding may be performed in the process of the wet type method.

As the transfer device 212, a transfer device which enables a current of predetermined current density to be supplied to the electrophotographic photoreceptor when the transfer device transfers a toner image formed on the electrophotographic photoreceptor 207 to the recording medium 500 is preferable.

The cleaning device 213 is used for removing a residual toner adhering to the surface of the electrophotographic photoreceptor after the transfer process. Thus, the electrophotographic photoreceptor having a surface cleaned by the cleaning device 213 is repeatedly served in the image forming process. As the cleaning device, a cleaning blush, a cleaning roll, and the like may be used in addition to a cleaning blade. Among these devices, the cleaning blade is preferably used. As the material of the cleaning blade, urethane rubber, neoprene rubber, silicone rubber, and the like are included.

As illustrated in FIG. 3, the image forming apparatus according to the exemplary embodiment may further include an erasing light-irradiation device 214 as an erasing device for removing residual potential on the electrophotographic photoreceptor. Accordingly, when the electrophotographic photoreceptor is repeatedly used, occurrence of a situation in which the residual potential on the electrophotographic photoreceptor remains at the next cycle is prevented, and thus it is possible to improve image quality more.

Second Exemplary Embodiment

Figure 4:
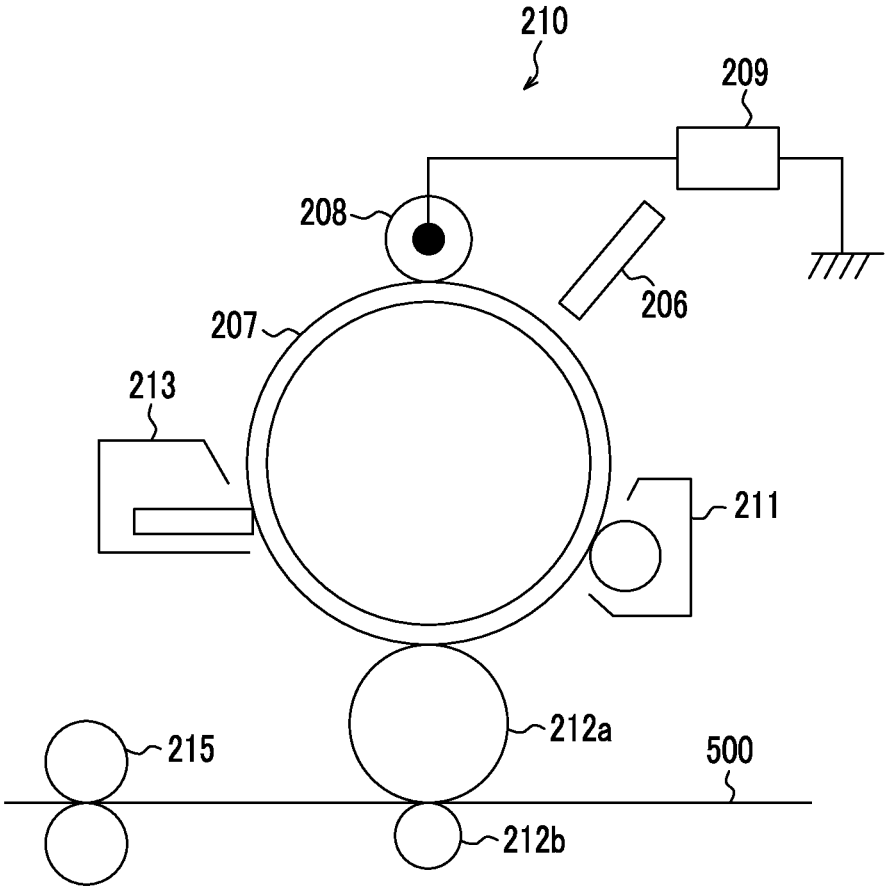
FIG. 4 is a schematic diagram illustrating a basic configuration of an image forming apparatus according to a second exemplary embodiment.

FIG. 4 is a schematic diagram illustrating a basic configuration of an image forming apparatus according to a second exemplary embodiment. The image forming apparatus 210 illustrated in FIG. 4 includes an intermediate transfer type transfer device which transfers a toner image formed on the electrophotographic photoreceptor 207 to a primary transfer member 212*a*, and then transfers the toner image to the recording medium 500 which is fed to a space between the primary transfer member 212*a* and a secondary transfer member 212*b*. Thus, when the transfer is performed, a current of predetermined current density may be supplied to the electrophotographic photoreceptor from the primary transfer member 212*a*. Although not illustrated in FIG. 4, the image forming apparatus 210 may further include an erasing device similarly to in the image forming apparatus 200 illustrated in FIG. 3. Other components of the image forming apparatus 210 are similar to those of the image forming apparatus 200.

The image forming apparatus 210 is different from the image forming apparatus 200 in that the intermediate transfer type is applied. However, similarly to in a case of the image forming apparatus 200 according to the first exemplary embodiment, occurrence of image defect is prevented by combining the electrophotographic photoreceptor 207 and a charging device including the charging member according to the exemplary embodiment.

When a toner image formed on the electrophotographic photoreceptor 207 is transferred to the primary transfer member 212*a*, the current of predetermined current density is supplied to the electrophotographic photoreceptor 207 from the primary transfer member 212*a*, and thus it is possible to prevent fluctuation of a transfer current due to the type, the material, and the like of the recording medium 500. Accordingly, it is possible to control the quantity of charges flowing to the electrophotographic photoreceptor 207, with high accuracy. As a result, enhancement of image quality and reduction of a load against the environment may be achieved at a higher level.

Third Exemplary Embodiment

Figure 5:
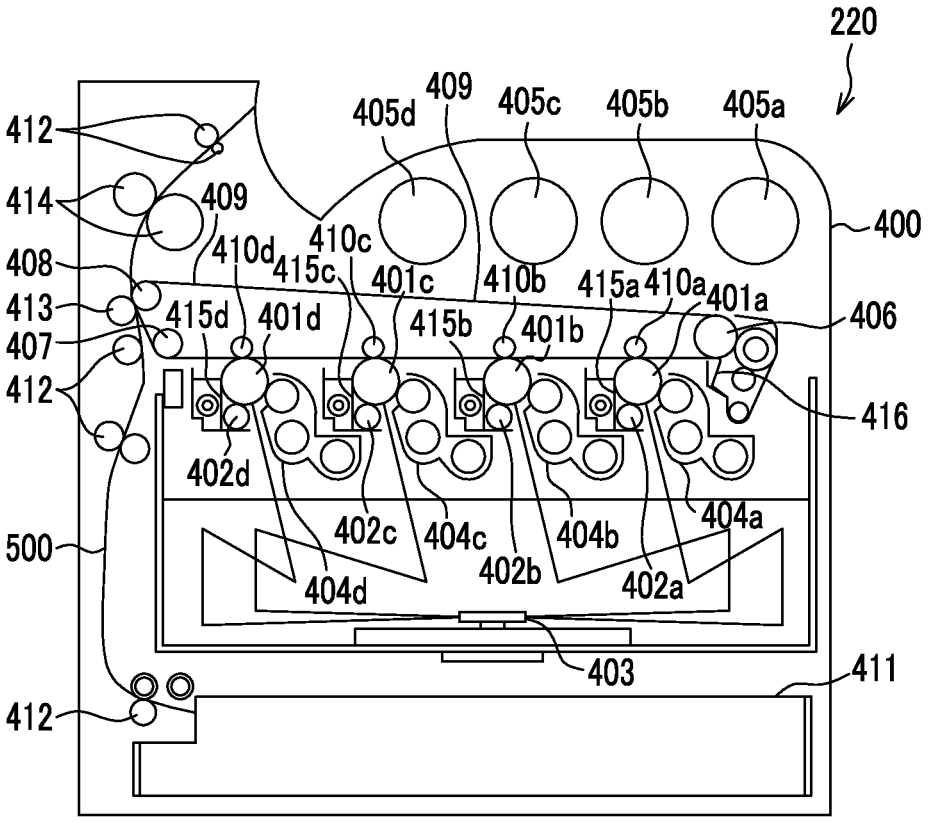
FIG. 5 is a schematic diagram illustrating a basic configuration of an image forming apparatus according to a third exemplary embodiment.

FIG. 5 is a schematic diagram illustrating a basic configuration of an image forming apparatus according to a third exemplary embodiment. The image forming apparatus 220 illustrated in FIG. 5 is an intermediate transfer type image forming apparatus. In the image forming apparatus 220, four electrophotographic photoreceptor 401*a* to 401*d* are provided so as to be parallel with each other along an intermediate transfer belt 409 in a housing 400. Regarding the four electrophotographic photoreceptor 401*a* to 401*d*, for example, the electrophotographic photoreceptor 401*a* enables formation of an image of a yellow color, the electrophotographic photoreceptor 401*b* enables formation of an image of a magenta color, the electrophotographic photoreceptor 401*c* enables formation of an image of a cyan color, and the electrophotographic photoreceptor 401*d* enables formation of an image of a black color.

Each of the electrophotographic photoreceptor 401*a* to 401*d* may be rotated in a specific direction (counterclockwise on a surface of paper). Charging members (charging rolls) 402*a* to 402*d*, developing devices 404*a* to 404*d*, primary transfer rolls 410*a* to 410*d*, and cleaning blades 415*a* to 415*d* are provided along a rotation direction of the electrophotographic photoreceptor 401*a* to 401*d*. Toners with four colors of black, yellow, magenta, and cyan which are respectively accommodated in toner cartridges 405*a* to 405*d* may be respectively supplied to the developing device 404*a* to 404*d*. The primary transfer rolls 410*a* to 410*d* respectively contact with the electrophotographic photoreceptor 401*a* to 401*d* with the intermediate transfer belt 409 interposed between the primary transfer rolls 410*a* to 410*d* and the electrophotographic photoreceptor 401*a* to 401*d*.

A laser beam source (exposure device) 403 is provided in the housing 400. Charged surfaces of the electrophotographic photoreceptor 401*a* to 401*d* may be irradiated with laser beams emitted from the laser beam source 403. Thus, processes of charging, exposure, developing, primary transfer, and cleaning are sequentially performed in the rotation process of the electrophotographic photoreceptor 401*a* to 401*d* and toner images of respective colors are superimposed on the intermediate transfer belt 409. A result of superimposition is transferred.

The intermediate transfer belt 409 is supported with tension by a driving roll 406, a back roll 408, and a stretching roll 407, and may be rotated without occurrence of flexure due to rotation of these rolls. A secondary transfer roll 413 is provided so as to contact with the back roll 408 with the intermediate transfer belt 409 interposed between the secondary transfer roll 413 and the back roll 408. The surface of intermediate transfer belt 409 which passes through a space between the back roll 408 and the secondary transfer roll 413 is cleaned by, for example, a cleaning blade 416 which is provided in the vicinity of the driving roll 406. Then, the intermediate transfer belt 409 is repeatedly served in the next image forming process.

A recording medium container 411 is provided in the housing 400. The recording medium 500 such as paper, in the recording medium container 411 is sequentially fed to a space between the intermediate transfer belt 409 and the secondary transfer roll 413 and a space between two fixation rolls 414, which contact with each other, by feeding rolls 412. Then, the recording medium 500 is discharged to the outside of the housing 400.

In the above descriptions, a case in which the intermediate transfer belt 409 is used as an intermediate transfer member is described. The intermediate transfer member may have a belt shape as with the intermediate transfer belt 409, or have a drum shape.

Process Cartridge

A process cartridge according to the exemplary embodiment includes an image holding member and a charging device, and is detachable from the image forming apparatus. The charging device includes the charging member according to the exemplary embodiment which contacts with a surface of the image holding member and charges the surface of the image holding member.

Figure 6:
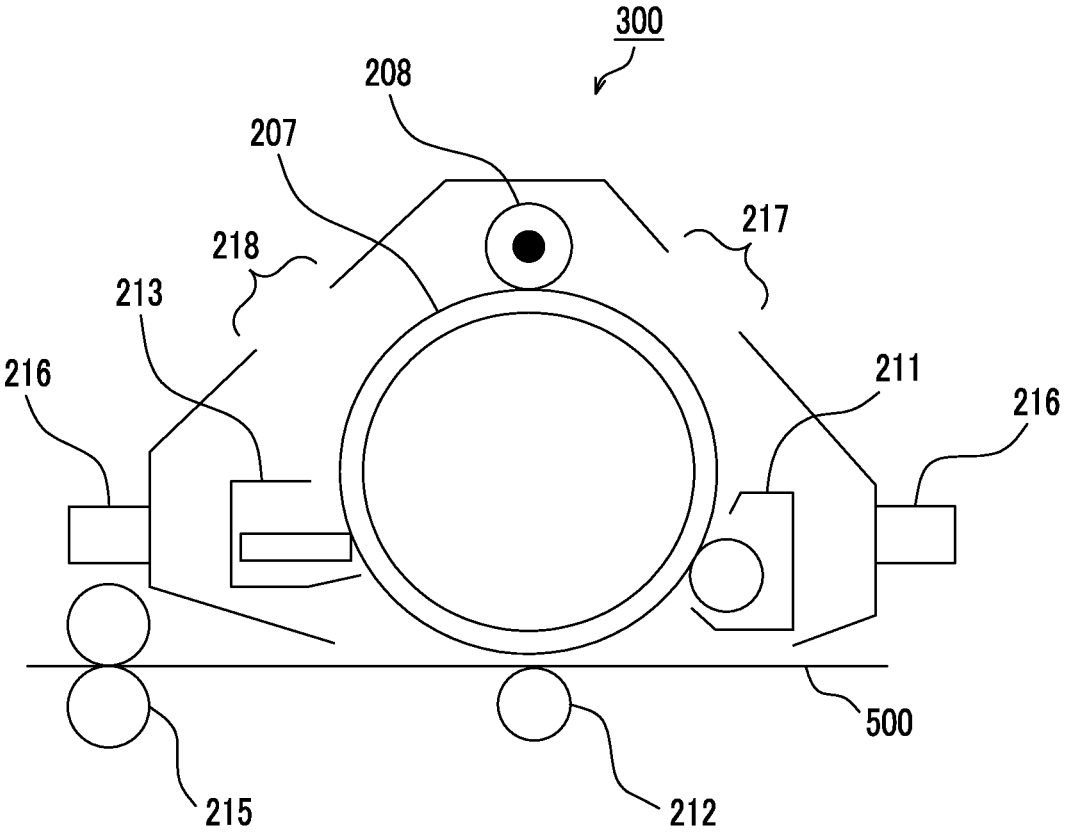
FIG. 6 is a schematic diagram illustrating an example of a process cartridge according to the exemplary embodiment.

FIG. 6 is a schematic diagram illustrating an example of the process cartridge according to the exemplary embodiment. The process cartridge 300 illustrated in FIG. 6 is obtained by combining and integrating the electrophotographic photoreceptor (an example of the image holding member) 207, the charging device 208, the developing device 211, the cleaning device 213, an opening portion 217 for exposure, and an opening portion 218 for erasing and exposure by using a fitting rail 216. The developing device 211 supplies the toner to the electrophotographic photoreceptor 207.

The process cartridge 300 is detachable from the image forming apparatus configured by the transfer device 212, the fixation device 215, and other components (not illustrated). The process cartridge 300 constitutes the image forming apparatus along with the image forming apparatus.

EXAMPLES

The exemplary embodiments of the invention will be described in detail referring to examples. However, the exemplary embodiments of the invention are not limited to the following examples. Unless otherwise stated, a "part" means a "part by weight".

Preparation of Electrophotographic Photoreceptor 1

100 parts of zinc oxide (average particle diameter of 70 nm, product manufactured by Tayca Corporation, specific surface area value of 15 $m^2/g$) and 500 parts of tetrahydrofuran are stirred and mixed. 1.25 parts of a silane coupling agent (KBM603: product manufactured by Shin-Etsu Chemical Co., Ltd) is added to the obtained mixture, and stirring is performed for two hours. Then, toluene is removed by distillation and baking is performed at 120° C. for three hours. Thus, a silane-coupling-agent surface-treated zinc oxide pigment is obtained.

60 parts of the zinc oxide pigment subjected to the surface treatment, 0.6 parts of alizarin, 13.5 parts of a hardener (blocked isocyanates (Sumidur 3175: product manufactured by Sumitomo Bayer Urethane Co., Ltd)), and 15 parts of butyral resin (S-LEC BM-1: product manufactured by SEKISUI CHEMICAL CO., LTD.) are dissolved in 85 parts of methyl ethyl ketone, and thereby a solution is obtained. 38 parts of the obtained solution and 25 parts of methyl ethyl ketone are mixed. The mixture is dispersed in a sand mill by using glass beads having a diameter of 1 mmϕ for two hours and thereby a dispersion is obtained. 0.005 parts of dioctyl tin dilaurate as a catalyst and 4.0 parts of silicone resin particles (Tospearl 145: product manufactured by Momentive Performance Materials Inc.) are added to the obtained dispersion, and thereby a coating liquid for forming an undercoating layer is obtained.

This coating liquid is applied onto an aluminum substrate by using a dipping coating method, and drying and curing are performed at 170° C. for 40 minutes. Thus, an undercoating layer having a thickness of 25 μm is obtained.

Then, a photosensitive layer (photosensitive layer having a layered structure of a charge generation layer and a charge transport layer) is formed on the formed undercoating layer as follows.

First, a mixture of 15 parts of hydroxy gallium phthalocyanine as the charge generation material, 10 parts of vinyl chloride-vinyl acetate copolymer resin (VMCH, product manufactured by NUC corporation) as the binder resin, 200 parts of N-butyl acetate is obtained. The hydroxy gallium phthalocyanine has a diffraction peak at the Bragg angle) (2θ±0.2° of at least 7.3°, 16.0°, 24.9°, and 28.0° in an X-ray diffraction spectrum obtained by using a Cukα ray. This mixture is dispersed in the sand mill by using glass beads having a diameter of 1 mmϕ for four hours. 175 parts of N-butyl acetate, 180 parts of methyl ethyl ketone are added to the obtained dispersion. The obtained mixture is stirred and thereby a coating liquid for a charge generation layer is obtained.

This coating liquid for a charge generation layer is applied onto the undercoating layer by using a dipping coating method, is dried at the room temperature (22° C.), and thereby the charge generation layer having a thickness of 0.2 μm is formed.

Then, 1 part of tetrafluoroethylene resin particles, 0.02 parts of fluorine graft polymer, 5 parts of tetrahydrofuran, and 2 parts of toluene are sufficiently stirred and mixed, and thereby a tetrafluoroethylene resin particle suspension is obtained.

4 parts of N,N'-diphenyl-N,N'-bis (3-methylphenyl)-[1,1'] biphenyl-4,4'-diamine as the charge transport material, 6 parts of bisphenol Z-type polycarbonate resin (viscosity-average molecular weight of 40,000), and 23 parts of tetrahydrofuran are mixed and dissolved in 10 parts of toluene. Then, the tetrafluoroethylene resin particle suspension is added to the obtained mixture and is stirred and mixed. Dispersion treatment is repeated 6 times and thereby a tetrafluoroethylene resin particle dispersion is obtained. The dispersing treatment is performed by increasing pressure up to 400 Kgf/cm$^2$ ($3.92\times10^{-1}$ Pa) by using a high-pressure homogenizer (product manufactured by Nanomizer Inc., product name: LA-33S) in which a penetration type chamber having a fine channel is mounted. 0.2 parts of 2,6-di-t-butyl-4-methylphenol is mixed and thereby a coating liquid for forming a charge transport layer is obtained. This coating liquid is applied onto the charge generation layer, is dried at 115° C. for 40 minutes, and thereby the charge transport layer having a film thickness of 22 μm is formed.

Thus, electrophotographic photoreceptor 1 which includes the charge generation layer and the charge transport layer on the undercoating layer in this order is obtained.

Preparation of Electrophotographic Photoreceptor 2

Electrophotographic photoreceptor 2 is prepared similarly to the electrophotographic photoreceptor 1 except that the film thickness of the charge transport layer is 34 μm.

Example A

Example A1

Preparation of Rubber Composition

A mixture of the following composition is kneaded by using a 2.5-L kneader, and thereby a rubber composition A1 is obtained.

- 100 parts of a rubber material (epichlorohydrin-ethylene oxide-allyl glycidyl ether copolymer rubber, Hydrin T3106: product manufactured by Zeon Corporation)
- 5 parts of a conductive material (carbon black #3030B: product manufactured by Mitsubishi Chemical Corporation)
- 1 part of an ion conductive material (benzyl trimethyl ammonium chloride, product name: "BTEAC", product manufactured by Lion Specialty Chemicals Co., Ltd.)
- 1.5 parts of a vulcanizing agent (organic sulfur, 4,4'-dithiodimorpholine, VULNOC R: product manufactured by OUCHI SHINKO CHEMICAL INDUSTRIAL CO., LTD.)
- 1.5 parts of a vulcanization accelerator A (thiazole-based, di-2-benzothiazolyl disulfide, NOCCELER DM-P: product manufactured by OUCHI SHINKO CHEMICAL INDUSTRIAL CO., LTD.)
- 1.8 parts of a vulcanization accelerator B (thiuram-based, tetraethyl thiuram disulfide, NOCCELER TET-G: product manufactured by OUCHI SHINKO CHEMICAL INDUSTRIAL CO., LTD.)
- 3 parts of a activator (zinc oxide, zinc oxide of JIS 1 grade, product manufactured by SEIDO CHEMICAL INDUSTRY CO., LTD.)
- 1.0 part of stearic acid
- 40 parts of heavy calcium carbonate Preparation of Elastic Roll A conductive support composed of SUM 23L which has a diameter of 8 mm is prepared by performing electroless nickel plating so as to be 5 μm in a plating thickness and then performing treatment by using hexavalent chromic acid.

The rubber composition A1 is extruded with screw rotation of 25 rpm by using a single-screw rubber extrusion machine which has an inner diameter of a cylinder of 60 mm and L/D (L represents a length (mm) of the screw, D represents a diameter (mm) of the screw) of 20, and the conductive support is continuously caused to pass through a crosshead. Thus, the conductive support is coated with the rubber composition A1. The temperature condition of the extrusion machine is set to 80° C. at any of a cylinder portion, a screw portion, a head portion, and a die portion. An unvulcanized rubber roll formed by the conductive support and the coated rubber composition is vulcanized in an air heating furnace at 165° C. for 70 minutes and thereby an elastic roll A1 having a diameter of 12 mm is obtained.

Formation of Surface Layer

The following mixture is dispersed in a bead mill and thereby a dispersion A1 is obtained. This dispersion A1 is diluted with methanol and the diluted dispersion is dipping coated onto a surface of the elastic roll A1. Then, drying by heating is performed at 160° C. for 30 minutes and a surface layer having a thickness of 10 μm is formed, and thus a charging roll A1 is obtained.

- 100 parts of a polymeric material (N-methoxymethylated nylon, F30K: product manufactured by Nagase ChemteX Corporation)
- 10 parts of a polymeric material (polyvinyl butyral resin, S-LEC BL-1: product manufactured by SEKISUI CHEMICAL CO., LTD.)
- 80 parts of a conductive material (phosphor-doped tin oxide particles)

(SP-2: product manufactured by Mitsubishi Materials Electronic Chemicals Co., Ltd, particle shape: spherical shape, powder resistivity of 22.2 Ω·cm)

- 20 parts of a filler (polyamide resin, Orgasol 2001 D Nat 1: product manufactured by Arkema Corporation)
- 4 parts of a catalyst (Nacure 4167: product manufactured by King industries, Inc.)
- 700 parts of a solvent (methanol)
- 200 parts of a solvent (butanol)

Physical Properties

Electron Emitting Energy on Surface

A measurement sample is picked from a surface of the obtained charging roll by using a cutter. Then, the electron emitting energy (cps$^{0.5}$/eV) of the picked measurement sample is measured by using an atmospheric photoelectron spectroscopy (photoemission yield spectroscopy in air AC-2 manufactured by RIKEN KEIKI Co., Ltd.). The results are shown in Table 1 below.

Evaluation Test

Evaluation of Image Quality

Electrophotographic photoreceptor 1 (charge transport layer having a film thickness of 22 μm) and the charging roll A1 are mounted in a drum cartridge of a copying machine ApeosPort-V C3320 (product manufactured by Fuji Xerox Co., Ltd.), as a contact type charging device for charging an image holding member (electrophotographic photoreceptor).

Using the copying machine, printing is performed with a half-tone of 50%, 30% and 0% in a case where a process speed (=rotation speed of charging roll) is set to 128 mm/s and in a case where the process speed is set to 64 mm/s.

With respect to the first print (initial stage) and the 20,000th print, image quality is evaluated based on the following evaluation criteria.

A: no occurrence of an image defect such as density unevenness, a white spot, a colored spot, and a streak B: partial occurrence of a slight image defect such as density unevenness, a white spot, a colored spot, and a streak C: occurrence of a slight image defect such as density unevenness, a white spot, a colored spot, and a streak D: occurrence of an image defect such as density unevenness, a white spot, a colored spot, and a streak The evaluation results are shown in Table 1 below, provided that the evaluation results A to D shown in Table 1 each is the worst evaluation result among the evaluation results of the three kinds of prints (half-tone of 50%, 30% or 0%) of the first or 20,000th print.

Charging Unevenness Evaluation

An occurrence status of the charging unevenness is measured and evaluated by using the following method. The results are shown in Table 1 below.

A specific method of performing the evaluation test is as follows. After a voltage applied at a time of charging is set to be smaller than a normal value by 100 V, an image obtained by printing white paper is read by a scanner. The entire density of the read image is converted into 255 stages, and then variation σ of the density is set as an index of the charging unevenness.

Example A2

A charging roll is prepared and evaluated similarly to Example A1 except that the conductive material of the surface layer in Example A1 is changed as follows. The results are shown in Table 1 below.

130 parts of a conductive material (phosphor-doped tin oxide particles, SP-2: product manufactured by Mitsubishi Materials Electronic Chemicals Co., Ltd)

Example A3

A charging roll is prepared and evaluated similarly to Example A1 except that the conductive material of the surface layer in Example A1 is changed as follows. The results are shown in Table 1 below.

180 parts of a conductive material (phosphor-doped tin oxide particles, SP-2: product manufactured by Mitsubishi Materials Electronic Chemicals Co., Ltd)

Example A4

A charging roll is prepared and evaluated similarly to Example A2 except that Electrophotographic photoreceptor 1 used in the evaluation test of Example A2 is changed to Electrophotographic photoreceptor 2 (a film thickness of the charge transport layer: 34 μm). The results are shown in Table 1 below.

Comparative Example A1

A charging roll is prepared and evaluated similarly to Example A1 except that the conductive material of the surface layer in Example A1 is changed as follows. The results are shown in Table 1 below.

20 parts of a conductive material (carbon black, MONARCH 1000: product manufactured by Cabot Corporation)

Comparative Example A2

A charging roll is prepared and evaluated similarly to Example A1 except that the conductive material of the surface layer in Example A1 is changed as follows. The results are shown in Table 1 below.

130 parts of a conductive material (antimony-doped tin oxide, T-1: product manufactured by Mitsubishi Materials Electronic Chemicals Co., Ltd)

TABLE 1

| | | Examples | | | | Comparative Examples | |
|---|---|---|---|---|---|---|---|
| | | A1 | A2 | A3 | A4 | A1 | A2 |
| Conductive material | type | P-doped tin oxide | | | | carbon black | Sb-doped tin oxide |
| | addition amount (part by weight) | 80 | 130 | 180 | 130 | 20 | 130 |
| Filler (part by weight) | | 20 | | | | | |
| (Photoreceptor) Film thickness of charge transport layer [μm] | | 22 | | 34 | | 22 | |
| Electron emitting energy ($cps^{0.5}/eV$) | | 4.8 | 5.2 | 6.4 | 5.2 | 20.5 | 12.1 |
| Image quality evaluation (128 mm/s) | 1st print | A | A | A | A | B | C |
| | 20,000th print | B | A | B | B | D | D |
| Image quality evaluation (64 mm/s) | 1st print | B | A | A | A | D | C |
| | 20,000th print | C | A | B | B | D | D |
| Charging unevenness evaluation (64 mm/s, 1st print) | | 8 | 6 | 7 | 7 | 13 | 11 |

Example B

Example B1

Preparation of Rubber Composition

A mixture of the following composition is kneaded by using a 2.5-L kneader, and thereby a rubber composition B1 is obtained.

100 parts of a rubber material (epichlorohydrin-ethylene oxide-allyl glycidyl ether copolymer rubber, Hydrin T3106: product manufactured by Zeon Corporation)

5 parts of a conductive material (carbon black #3030B: product manufactured by Mitsubishi Chemical Corporation)

1 part of an ion conductive material (benzyl trimethyl ammonium chloride, product name: "BTEAC", product manufactured by Lion Specialty Chemicals Co., Ltd.)

1.5 parts of a vulcanizing agent (organic sulfur, 4,4'-dithiodimorpholine, VULNOC R: product manufactured by OUCHI SHINKO CHEMICAL INDUSTRIAL CO., LTD.)

1.5 parts of a vulcanization accelerator A (thiazole-based, di-2-benzothiazolyl disulfide, NOCCELER DM-P: product manufactured by OUCHI SHINKO CHEMICAL INDUSTRIAL CO., LTD.)

1.8 parts of a vulcanization accelerator B (thiuram-based, tetraethyl thiuram disulfide, NOCCELER TET-G: product manufactured by OUCHI SHINKO CHEMICAL INDUSTRIAL CO., LTD.)

3 parts of an activator (zinc oxide, zinc oxide of JIS 1 grade, product manufactured by SEIDO CHEMICAL INDUSTRY CO., LTD.)

1.0 part of stearic acid 40 parts of heavy calcium carbonate

Preparation of Elastic Roll

A conductive support configured from SUM 23L which has a diameter of 8 mm is prepared by performing electroless nickel plating so as to be 5 μm in a plating thickness and then performing treatment by using hexavalent chromic acid.

The rubber composition B1 is extruded with screw rotation of 25 rpm by using a single-screw rubber extrusion machine which has an inner diameter of a cylinder of 60 mm, and L/D (L represents a length (mm) of the screw, D represents a diameter (mm) of the screw) of 20 and the conductive support is continuously caused to pass through a crosshead. Thus, the conductive support is coated with the rubber composition B1. The temperature condition of the extrusion machine is set to 80° C. at any of a cylinder portion, a screw portion, a head portion, and a die portion. An unvulcanized rubber roll formed by the conductive support and the coated rubber composition is vulcanized in an air heating furnace at 165° C. for 70 minutes and thereby an elastic roll B1 having a diameter of 12 mm is obtained.

Formation of Surface Layer

The following mixture is dispersed in a bead mill and thereby a dispersion B1 is obtained. This dispersion B1 is diluted with methanol and the diluted dispersion is dipping-coated onto a surface of the elastic roll B1. Then, drying by heating is performed at 160° C. for 30 minutes and a surface layer having a thickness of 10 μm is formed, and thus a charging roll B1 is obtained.

100 parts of a polymeric material (N-methoxymethylated nylon, F30K: product manufactured by Nagase ChemteX Corporation)

10 parts of a polymeric material (polyvinyl butyral resin, S-LEC BL-1: product manufactured by SEKISUI CHEMICAL CO., LTD.)

20 parts of a conductive material (phosphor-doped tin oxide particles, SP-2: product manufactured by Mitsubishi Materials Electronic Chemicals Co., Ltd, particle shape: spherical shape, powder resistivity of 22.2 Ω·cm)

5 parts of a conductive material (carbon black, MONARCH 1000: product manufactured by Cabot Corporation)

20 parts of a filler (polyamide resin, Orgasol 2001 D Nat 1: product manufactured by Arkema Corporation)

4 parts of a catalyst (Nacure 4167: product manufactured by King industries, Inc.)

700 parts of a solvent (methanol)

200 parts of a solvent (butanol)

Regarding the obtained charging roll B1, physical properties are measured and an evaluation test is performed, similarly to Example A1. The results are shown in Table 2 below.

Example B2

A charging roll is prepared and evaluated similarly to Example B1 except that an addition amount of the conductive material of the surface layer in Example B1 is changed as follows. The results are shown in Table 2 below.

20 parts of a conductive material (phosphor-doped tin oxide particles, SP-2: product manufactured by Mitsubishi Materials Electronic Chemicals Co., Ltd)

10 parts of a conductive material (carbon black, MONARCH 1000: product manufactured by Cabot Corporation)

Example B3

A charging roll is prepared and evaluated similarly to Example B1 except that an addition amount of the conductive material of the surface layer in Example B1 is changed as follows. The results are shown in Table 2 below.

20 parts of a conductive material (phosphor-doped tin oxide particles, SP-2: product manufactured by Mitsubishi Materials Electronic Chemicals Co., Ltd)

15 parts of a conductive material (carbon black, MONARCH 1000: product manufactured by Cabot Corporation)

Example B4

A charging roll is prepared and evaluated similarly to Example B1 except that an addition amount of the conductive material of the surface layer in Example B1 is changed as follows. The results are shown in Table 2 below.

60 parts of a conductive material (phosphor-doped tin oxide particles, SP-2: product manufactured by Mitsubishi Materials Electronic Chemicals Co., Ltd)

5 parts of a conductive material (carbon black, MONARCH 1000: product manufactured by Cabot Corporation)

Example B5

A charging roll is prepared and evaluated similarly to Example B1 except that an addition amount of the conductive material of the surface layer in Example B1 is changed as follows. The results are shown in Table 2 below.

60 parts of a conductive material (phosphor-doped tin oxide particles, SP-2: product manufactured by Mitsubishi Materials Electronic Chemicals Co., Ltd)

10 parts of a conductive material (carbon black, MONARCH 1000: product manufactured by Cabot Corporation)

Example B6

A charging roll is prepared and evaluated similarly to Example B1 except that an addition amount of the conductive material of the surface layer in Example B1 is changed as follows. The results are shown in Table 2 below.

60 parts of a conductive material (phosphor-doped tin oxide particles, SP-2: product manufactured by Mitsubishi Materials Electronic Chemicals Co., Ltd)

15 parts of a conductive material (carbon black, MONARCH 1000: product manufactured by Cabot Corporation)

Example B7

A charging roll is prepared and evaluated similarly to Example B1 except that an addition amount of the conductive material of the surface layer in Example B1 is changed as follows. The results are shown in Table 2 below.

100 parts of a conductive material (phosphor-doped tin oxide particles, SP-2: product manufactured by Mitsubishi Materials Electronic Chemicals Co., Ltd)

5 parts of a conductive material (carbon black, MONARCH 1000: product manufactured by Cabot Corporation)

Example B8

A charging roll is prepared and evaluated similarly to Example B1 except that an addition amount of the conductive material of the surface layer in Example B1 is changed as follows. The results are shown in Table 2 below.

100 parts of a conductive material (phosphor-doped tin oxide particles, SP-2: product manufactured by Mitsubishi Materials Electronic Chemicals Co., Ltd)

10 parts of a conductive material (carbon black, MONARCH 1000: product manufactured by Cabot Corporation)

Example B9

A charging roll is prepared and evaluated similarly to Example B2 except that Electrophotographic photoreceptor 1 used in the evaluation test of Example B2 is changed to Electrophotographic photoreceptor 2 (a film thickness of the charge transport layer: 34 μm). The results are shown in Table 2 below.

100 parts of a conductive material (phosphor-doped tin oxide particles, SP-2: product manufactured by Mitsubishi Materials Electronic Chemicals Co., Ltd)

15 parts of a conductive material (carbon black, MONARCH 1000: product manufactured by Cabot Corporation)

Example B10

A charging roll is prepared and evaluated similarly to Example B2 except that Electophotographic photoreceptor 1 used in the evaluation test of Example B2 is changed to Electophotographic photoreceptor 2 (a film thickness of the charge transport layer: 34 μm). The results are shown in Table 2 below.

Comparative Example B1

A charging roll is prepared and evaluated similarly to Example B1 except that the type and an addition amount of the conductive material of the surface layer in Example B1 is changed as follows. The results are shown in Table 3 below.

18 parts of a conductive material (carbon black, MONARCH 1000: product manufactured by Cabot Corporation)

Comparative Example B2

A charging roll is prepared and evaluated similarly to Example B1 except that the type and an addition amount of the conductive material of the surface layer in Example B1 is changed as follows. The results are shown in Table 3 below.

20 parts of a conductive material (antimony-doped tin oxide, T-1: product manufactured by Mitsubishi Materials Electronic Chemicals Co., Ltd)

10 parts of a conductive material (carbon black, MONARCH 1000: product manufactured by Cabot Corporation)

Comparative Example B3

A charging roll is prepared and evaluated similarly to Example B1 except that the type and an addition amount of the conductive material of the surface layer in Example B1 is changed as follows. The results are shown in Table 3 below.

20 parts of a conductive material (antimony-doped tin oxide, T-1: product manufactured by Mitsubishi Materials Electronic Chemicals Co., Ltd)

15 parts of a conductive material (carbon black, MONARCH 1000: product manufactured by Cabot Corporation)

TABLE 2

| | | Examples | | | | | | | | | |
|---|---|---|---|---|---|---|---|---|---|---|---|
| | | B1 | B2 | B3 | B4 | B5 | B6 | B7 | B8 | B9 | B10 |
| Conductive material 1 | type | P-doped tin oxide | | | | | | | | | |
| | addition amount (part by weight) | 20 | 20 | 20 | 60 | 60 | 60 | 100 | 100 | 100 | 20 |
| Conductive material 2 | type | carbon black | | | | | | | | | |
| | addition amount (part by weight) | 5 | 10 | 15 | 5 | 10 | 15 | 5 | 10 | 15 | 10 |

TABLE 2-continued

| | | Examples | | | | | | | | | |
|---|---|---|---|---|---|---|---|---|---|---|---|
| | | B1 | B2 | B3 | B4 | B5 | B6 | B7 | B8 | B9 | B10 |
| Filler (part by weight) | | | | | | 20 | | | | | |
| (Photoreceptor) Film thickness of charge transport layer [μm] | | | | | | 22 | | | | | 34 |
| Electron emitting energy ($cps^{0.5}/eV$) | | 3.5 | 4.4 | 6.3 | 5.9 | 6.2 | 6.8 | 5.1 | 6.8 | 7.1 | 4.4 |
| Image quality evaluation (128 mm/s) | 1st print | A | A | B | A | A | B | A | A | A | A |
| | 20,000th print | A | A | C | B | B | C | B | C | C | B |
| Image quality evaluation (64 mm/s) | 1st print | A | A | B | A | A | B | A | B | B | A |
| | 20,000th print | A | A | C | B | B | C | B | C | C | B |
| Charging unevenness evaluation (64 mm/s, 1st print) | | 5 | 6 | 7 | 6 | 6 | 7 | 6 | 7 | 8 | 7 |

TABLE 3

| | | Comparative Examples | | |
|---|---|---|---|---|
| | | B1 | B2 | B3 |
| Conductive material 1 | type | carbon black | Sb-doped tin oxide | Sb-doped tin oxide |
| | addition amount (part by weight) | 18 | 20 | 20 |
| Conductive material 2 | type | none | carbon black | carbon black |
| | addition amount (part by weight) | — | 10 | 15 |
| Filler (part by weight) | | | 20 | |
| (Photoreceptor) Film thickness of charge transport layer [μm] | | | 22 | |
| Electron emitting energy ($cps^{0.5}/eV$) | | 19.1 | 10.8 | 13.8 |
| Image quality evaluation (128 mm/s) | 1st print | C | C | C |
| | 20,000th print | D | D | D |
| Image quality evaluation (64 mm/s) | 1st print | D | D | D |
| | 20,000th print | D | D | D |
| Charging unevenness evaluation (64 mm/s, 1st print) | | 15 | 12 | 14 |

Example C

Example C1

A charging roll is prepared and evaluated similarly to Example A2 except that the filler of the surface layer in Example A2 is not added. The results are shown in Table 4 below.

Example C2

A charging roll is prepared and evaluated similarly to Example B2 except that the filler of the surface layer in Example B2 is not added. The results are shown in Table 4 below.

Comparative Example C1

A charging roll is prepared and evaluated similarly to Example B1 except that the type and an addition amount of the conductive material of the surface layer in Example B1 is changed as follows and the filler of the surface layer in Example B1 is not added. The results are shown in Table 4 below.

20 parts of a conductive material (tin oxide, S-2000: product manufactured by Mitsubishi Materials Electronic Chemicals Co., Ltd)

15 parts of a conductive material (carbon black, MONARCH 1000: product manufactured by Cabot Corporation)

TABLE 4

| | | Examples | | Comparative Example |
|---|---|---|---|---|
| | | C1 | C2 | C1 |
| Conductive material 1 | type | P-doped tin oxide | | tin oxide |
| | addition amount (part by weight) | 130 | 20 | 20 |
| Conductive material 2 | type | none | carbon black | carbon black |
| | addition amount (part by weight) | | 10 | 15 |
| Filler (part by weight) | | | none | |
| (Photoreceptor) Film thickness of charge transport layer [μm] | | | 22 | |
| Electron emitting energy ($cps^{0.5}/eV$) | | 5.5 | 6.4 | 12.1 |
| Image quality evaluation (128 mm/s) | 1st print | A | B | C |
| | 20,000th print | C | C | D |
| Image quality evaluation (64 mm/s) | 1st print | B | C | D |
| | 20,000th print | C | C | D |
| Charging unevenness evaluation (64 mm/s, 1st print) | | 9 | 12 | 17 |

Example D

Example D1

Preparation of Rubber Composition

A mixture of the following composition is kneaded by using a 2.5-L kneader, and thereby a rubber composition D1 is obtained.

100 parts of a rubber material (epichlorohydrin-ethylene oxide-allyl glycidyl ether copolymer rubber, Hydrin T3106: product manufactured by Zeon Corporation)

5 parts of a conductive material (carbon black #3030B: product manufactured by Mitsubishi Chemical Corporation)

1 part of an ion conductive material (benzyl trimethyl ammonium chloride, product name: "BTEAC", product manufactured by Lion Specialty Chemicals Co., Ltd.)

1.5 parts of a vulcanizing agent (organic sulfur, 4, 4'-dithiodimorpholine, VULNOC R: product manufactured by OUCHI SHINKO CHEMICAL INDUSTRIAL CO., LTD.)

1.5 parts of a vulcanization accelerator A (thiazole-based, di-2-benzothiazolyl disulfide, NOCCELER DM-P: product manufactured by OUCHI SHINKO CHEMICAL INDUSTRIAL CO., LTD.)

1.8 parts of a vulcanization accelerator B (thiuram-based, tetraethyl thiuram disulfide, NOCCELER TET-G: product manufactured by OUCHI SHINKO CHEMICAL INDUSTRIAL CO., LTD.)

3 parts of an activator (zinc oxide, zinc oxide of JIS 1 grade product manufactured by SEIDO CHEMICAL INDUSTRY CO., LTD.)

1.0 part of stearic acid 40 parts of heavy calcium carbonate

Preparation of Elastic Roll

A conductive support configured from SUM23L which has a diameter of 8 mm is prepared by performing electroless nickel plating so as to be 5 μm in a plating thickness and then performing treatment by using hexavalent chromic acid.

The rubber composition D1 is extruded with screw rotation of 25 rpm by using a single-screw rubber extrusion machine which has an inner diameter of a cylinder of 60 mm, and L/D (L represents a length (mm) of the screw, D represents a diameter (mm) of the screw) of 20 and the conductive support is continuously caused to pass through a crosshead. Thus, the conductive support is coated with the rubber composition D1. The temperature condition of the extrusion machine is set to 80° C. at any of a cylinder portion, a screw portion, a head portion, and a die portion. An unvulcanized rubber roll formed by the conductive support and the coated rubber composition is vulcanized in an air heating furnace at 165° C. for 70 minutes and thereby an elastic roll D1 having a diameter of 12 mm is obtained.

Formation of Surface Layer

The following mixture is dispersed in a bead mill and thereby a dispersion D1 is obtained. This dispersion D1 is diluted with methanol and the diluted dispersion is applied onto a surface of the elastic roll D1 by using a dipping coating method. Then, drying by heating is performed at 160° C. for 30 minutes and a surface layer having a thickness of 10 μm is formed, and thus a charging roll D1 is obtained.

100 parts of a polymeric material (N-methoxymethylated nylon, F30K: product manufactured by Nagase ChemteX Corporation)

10 parts of a polymeric material (polyvinyl butyral resin, S-LEC BL-1: product manufactured by SEKISUI CHEMICAL CO., LTD.)

130 parts of a conductive material (titanium oxide particles coated with phosphor-doped tin oxide)

(W-4: product manufactured by Mitsubishi Materials Electronic Chemicals Co., Ltd, primary particle diameter of 10 nm, particle shape: spherical shape)

20 parts of a filler (polyamide resin, Orgasol 2001 D Nat 1: product manufactured by Arkema Corporation)

4 parts of a catalyst (Nacure 4167: product manufactured by King Industries, Inc.)

700 parts of a solvent (methanol)

200 parts of a solvent (butanol)

Regarding the obtained charging roll D1, physical properties are measured and an evaluation test is performed, similarly to Example A1. The results are shown in Table 5 below.

Example D2

A charging roll is manufactured and evaluated similarly to Example D1 except that the conductive material of the surface layer in Example D1 is changed as follows. The results are shown in Table 5 below.

80 parts of a conductive material (titanium oxide particles coated with phosphor-doped tin oxide, W-4: product manufactured by Mitsubishi Materials Electronic Chemicals Co., Ltd)

Example D3

A charging roll is prepared and evaluated similarly to Example D1 except that Electrophotographic photoreceptor 1 used in the evaluation test of Example D1 is changed to Electrophotographic photoreceptor 2 (a film thickness of the charge transport layer: 34 μm). The results are shown in Table 5 below.

180 parts of a conductive material (titanium oxide particles coated with phosphor-doped tin oxide, W-4: product manufactured by Mitsubishi Materials Electronic Chemicals Co., Ltd)

Example D4

A charging roll is prepared and evaluated similarly to Example D1 except that Electophotographic photoreceptor 1 used in the evaluation test of Example D1 is changed to Electophotographic photoreceptor 2 (a film thickness of the charge transport layer: 34 μm). The results are shown in Table 5 below.

Comparative Example D1

A charging roll is prepared and evaluated similarly to Example D1 except that the conductive material of the surface layer in Example D1 is changed as follows. The results are shown in Table 5 below.

20 parts of a conductive material (carbon black, MONARCH 1000: product manufactured by Cabot Corporation)

Comparative Example D2

A charging roll is prepared and evaluated similarly to Example D1 except that the conductive material of the surface layer in Example D1 is changed as follows. The results are shown in Table 5 below.

130 parts of a conductive material (antimony-doped tin oxide, T-1: product manufactured by Mitsubishi Materials Electronic Chemicals Co., Ltd)

TABLE 5

| | | Examples | | | | Comparative Examples | |
|---|---|---|---|---|---|---|---|
| | | D1 | D2 | D3 | D4 | D1 | D2 |
| Conductive material | type | titanium oxide coated with p-doped tin oxide | | | | carbon black | Sb-doped tin oxide |
| | addition amount (part by weight) | 130 | 80 | 180 | 130 | 20 | 130 |
| Filler (part by weight) | | 20 | | | | 20 | |
| (Photoreceptor) Film thickness of charge transport layer [μm] | | 22 | | | 34 | 22 | |
| Electron emitting energy ($cps^{0.5}/eV$) | | 5.2 | 4.8 | 4.8 | 5.4 | 20.5 | 12.1 |
| Image quality evaluation (128 mm/s) | 1st print | A | B | A | A | B | C |
| | 20,000th print | A | B | B | B | D | D |
| Image quality evaluation (64 m m/s) | 1st print | A | B | A | B | D | C |
| | 20,000th print | A | C | B | B | D | D |
| Charging unevenness evaluation (64 mm/s, 1st print) | | 6 | 8 | 7 | 7 | 13 | 11 |

Example E

Example E1

A charging roll is prepared and evaluated similarly to Example D1 except that the filler of the surface layer in Example D1 is not added. The results are shown in Table 6 below.

TABLE 6

| | | Example E1 |
|---|---|---|
| Conductive material | type | titanium oxide coated with p-doped tin oxide |
| | addition amount (part by weight) | 130 |
| Filler (part by weight) | | none |
| (Photoreceptor) Film thickness of charge transport layer [μm] | | 22 |
| Electron emitting energy ($cps^{0.5}/eV$) | | 5.2 |
| Image quality evaluation (128 mm/s) | 1st print | A |
| | 20,000th print | C |
| Image quality evaluation (64 mm/s) | 1st print | B |
| | 20,000th print | C |
| Charging unevenness evaluation (64 mm/s, 1st print) | | 8 |

Example F

Example F1

A charging roll is prepared and evaluated similarly to Example B1 except that an addition amount of the conductive material of the surface layer in Example B1 is changed as follows. The results are shown in Table 7 below.

100 parts of a conductive material (phosphor-doped tin oxide particles, SP-2: product manufactured by Mitsubishi Materials Electronic Chemicals Co., Ltd)

20 parts of a conductive material (carbon black, MONARCH 1000: product manufactured by Cabot Corporation)

Example F2

A charging roll is prepared and evaluated similarly to Example B1 except that an addition amount of the conductive material of the surface layer in Example B1 is changed as follows. The results are shown in Table 7 below.

20 parts of a conductive material (phosphor-doped tin oxide particles, SP-2: product manufactured by Mitsubishi Materials Electronic Chemicals Co., Ltd)

0 part of a conductive material (carbon black, MONARCH 1000: product manufactured by Cabot Corporation)

TABLE 7

| | | Examples | |
|---|---|---|---|
| | | F1 | F2 |
| Conductive material 1 | type | P-doped tin oxide | |
| | addition amount (part by weight) | 100 | 20 |
| Conductive material 2 | type | carbon black | |
| | addition amount (part by weight) | 20 | 0 |
| Filler (part by weight) | | 20 | |
| (Photoreceptor) Film thickness of charge transport layer [μm] | | 22 | |
| Electron emitting energy ($cps^{0.5}/eV$) | | 9.5 | 1.8 |
| Image quality evaluation (128 mm/s) | 1st print | B | A |
| | 20,000th print | C | B |
| Image quality evaluation (64 mm/s) | 1st print | C | A |
| | 20,000th print | C | C |
| Charging unevenness evaluation (64 mm/s, 1st print) | | 9 | 5 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging member comprising:

a conductive support; and a surface layer provided on the conductive support, wherein electron emitting energy on a surface of the charging member is equal to or less than 10 $cps^{0.5}/eV$.

2. The charging member according to claim 1, wherein the electron emitting energy on the surface of the charging member is in a range of from 4 $cps^{0.5}/eV$ to 6 $cps^{0.5}/eV$.

3. The charging member according to claim 1, wherein the surface layer includes a conductive material containing phosphor-doped tin oxide.

4. The charging member according to claim 3, wherein the conductive material containing the phosphor-doped tin oxide is at least one member selected from phosphor-doped tin oxide particles and conductive metal oxide particles coated with phosphor-doped tin oxide.

5. The charging member according to claim 3, wherein the surface layer includes a resin, and a content of the conductive material containing the phosphor-doped tin oxide in the surface layer is in a range of from 5 parts by weight to 180 parts by weight relative to 100 parts by weight of the resin.

6. The charging member according to claim 3, wherein the surface layer further includes carbon black.

7. The charging member according to claim 6, wherein the surface layer includes a resin, a content of the conductive material containing the phosphor-doped tin oxide in the surface layer is in a range of from 10 parts by weight to 100 parts by weight relative to 100 parts by weight of the resin, and a content ratio of the conductive material including the phosphor-doped tin oxide and the carbon black (conductive material including the phosphor-doped tin oxide: carbon black (weight ratio)) is 10:25 to 100:5.

8. The charging member according to claim 3, wherein the surface layer further includes a filler.

9. The charging member according to claim 1, wherein the charging member is used for charging to be performed by a DC charging method.

10. A process cartridge that is detachable from an image forming apparatus, comprising:

an image holding member; and a charging device that includes the charging member according to claim 1 which contacts with a surface of the image holding member and charges the surface of the image holding member.

11. The process cartridge according to claim 10, wherein the image holding member is an electrophotographic photoreceptor in which at least a surface layer having a thickness of 25 μm or greater and having charge transportability is provided on a substrate.

12. The process cartridge according to claim 10, wherein a rotation speed of the charging member is equal to or less than 100 mm/s.

13. An image forming apparatus comprising:

an image holding member;

a charging device that includes the charging member according to claim 1 which contacts with a surface of the image holding member and charges the surface of the image holding member;

a latent image forming device that forms a latent image on a charged surface of the image holding member;

a developing device that develops the latent image formed on the surface of the image holding member by using a toner, and forms a toner image; and a transfer device that transfers the toner image formed on the surface of the image holding member to a recording medium.

14. The image forming apparatus according to claim 13, wherein the image holding member is an electrophotographic photoreceptor in which at least a surface layer having a thickness of 25 μm or greater and having charge transportability is provided on a substrate.

15. The image forming apparatus according to claim 13, wherein a rotation speed of the charging member is equal to or less than 100 mm/s.

* * * * *